US006739361B2

(12) United States Patent
Krimmer et al.

(10) Patent No.: US 6,739,361 B2
(45) Date of Patent: May 25, 2004

(54) METHOD AND ARRANGEMENT FOR OBTAINING A LOW-EMISSION TANKING OPERATION OF A TANK SYSTEM INCLUDING A TANK SYSTEM OF A MOTOR VEHICLE

(75) Inventors: Erwin Krimmer, Pluederhausen (DE); Wolfgang Schulz, Bietigheim-Bissingen (DE); Helmut Schwegler, Pleidelsheim (DE); Georg Mallebrein, Korntal-Muenchingen (DE); Rainer Hahner, St. Agustin (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/216,394

(22) Filed: Aug. 12, 2002

(65) Prior Publication Data

US 2003/0047232 A1 Mar. 13, 2003

(30) Foreign Application Priority Data

Aug. 11, 2001 (DE) ..... 101 39 619

(51) Int. Cl.[7] ..... B65B 31/00

(52) U.S. Cl. ..... 141/198; 141/1; 141/5; 137/587

(58) Field of Search ..... 141/1, 4, 5, 7, 141/59, 192, 198, 95; 137/587, 588

(56) References Cited

U.S. PATENT DOCUMENTS

| | | | | | |
|---|---|---|---|---|---|
| 4,862,856 | A | * | 9/1989 | Yokoe et al. | 123/519 |
| 4,903,672 | A | * | 2/1990 | MacKinnon | 123/520 |
| 5,890,474 | A | | 4/1999 | Schnaibel et al. | |
| 6,253,802 | B1 | * | 7/2001 | Enge | 141/59 |
| 2002/0116102 | A1 | * | 8/2002 | Kaiser et al. | 701/29 |

* cited by examiner

*Primary Examiner*—J. Casimer Jacyna
(74) *Attorney, Agent, or Firm*—Walter Ottesen

(57) ABSTRACT

A method and an apparatus operate a tank system including a tank system of a motor vehicle. The tank system includes a tank for receiving a fluid medium forming a volatile substance and an adsorption filter connected to the tank for receiving the volatile substance which emanates from the tank. A shutoff valve is connected to the adsorption filter and is drivable between an open position and a closed position whereat the tank system is closed off to the ambient. A tank fill-level sensor detects the fill level of the fluid medium in the tank. A fill pipe is connected to the tank for filling with the fluid medium. The fill level is detected while tanking and the shutoff valve is driven into the closed position when the fill level has reached a maximum fill level.

15 Claims, 2 Drawing Sheets

METHOD AND ARRANGEMENT FOR OBTAINING A LOW-EMISSION TANKING OPERATION OF A TANK SYSTEM INCLUDING A TANK SYSTEM OF A MOTOR VEHICLE

FIELD OF THE INVENTION

The invention relates, generally, to control units for monitoring the emission of volatile substances in tank systems, especially of fuel vapors in motor vehicles as a consequence of a tanking operation. The invention relates especially to such a tank system wherein an adsorption filter is provided for taking up the forming volatile substances and wherein a tightness check of a tank leakage diagnostic arrangement is carried out from time to time.

BACKGROUND OF THE INVENTION

In motor vehicles driven by internal combustion engines, a venting of the fuel supply tank is absolutely necessary for a continued supply of fuel. Air must flow into the tank when fuel is consumed because a vacuum would otherwise form in the tank and the fuel flow would be interrupted. The tank is, however, also to be vented in order to permit the contents of the tank sufficient opportunity for expansion during warming. In addition, enough air must exit from the tank when tanking so that the introduced fuel does not immediately splash out of the fill pipe provided on the tank.

In motor vehicles, tank-venting systems are increasingly utilized having a so-called "on-board refueling vapor recovery" (ORVR) function. Here, vaporizing or excessive fuel vapor or fuel gas is not directed into the ambient but is directed into an active charcoal filter (ACF) via a venting line having a large cross section. During a tanking operation, the necessary overpressure therefor adjusts because the particular pistol-like fill nozzle tightly closes against the fill stub with the aid of a rubber bellows. The fuel vapor is stored in the ACF and is, during driving operation of the motor vehicle, supplied via an electromagnetic tank-venting valve to an intake manifold of the engine and therewith to the combustion. In this way, an emission of the environmentally damaging fuel vapors from the tank is substantially prevented from reaching the ambient and, at the same time, the vapors, which are supplied to the engine, are themselves utilized as fuel whereby the fuel consumption is reduced.

In this connection, reference is made to the statutory requirements for operating internal combustion engines in regions of the United States. According to these statutory requirements, it is necessary that motor vehicles wherein volatile fuels such as gasoline are used, have a control unit of the kind mentioned initially herein which is capable to locate a leakage in the tank or in the entire fuel tank system utilizing on-board means.

In summary, tank systems of the kind mentioned initially herein have to fulfill the following tasks:

(a) a tanking operation of the fuel tank must be reliably ended when a pregiven maximum tank fill level is reached and especially while avoiding a splashing of fuel. The end of tanking is reached when the fuel in the fill pipe climbs up to the fill nozzle and then switches the latter off.

(b) during tanking, it is to be ensured that air or fuel vapor displaced in the fuel tank (in the above-mentioned ORVR tank systems) can escape from the tank into the ACF.

(c) an operational venting of the fuel tank or a pressure compensation in the tank must be guaranteed all of the time.

(d) in the case of damage to the vehicle (especially when the vehicle is turned over), a draining of the fuel is to be effectively prevented (so-called roll-over function).

(e) a tank leakage diagnosis for checking the tank system as to tightness must be possible all of the time especially during driving operation (so-called on-board diagnostic function).

From U.S. Pat. No. 5,890,474, it is known for carrying out a leakage diagnosis that first the tank system is closed off with respect to the ambient by means of an electrically drivable check valve and, thereafter, the tank system is charged with an overpressure or underpressure. A leakage diagnostic method, which is improved with respect to the above, provides, in contrast, a switch-over valve by means of which a leakage diagnosis pump can be switched over between a reference leak and the tank or the tank system.

In addition, known tank systems for satisfying the above-mentioned functions have a plurality of mechanical tanking valves. Inter alia, a float valve ensures the above-mentioned escape of displaced air during a tanking operation. When the tank fill level reaches the provided maximum elevation, then the float valve closes and thereby prevents an escape of the displaced air. As a consequence, the pressure in the tank increases which, in turn, causes the fuel in the fill pipe to climb until it reaches the level of the fill nozzle. The fill nozzle detects this liquid fuel and thereupon shuts off the flow of fuel. For this reason, measures are provided which effectively prevent a splashing of fuel also in this tanking phase.

SUMMARY OF THE INVENTION

In view of the above, it is an object of the invention to provide a tank system as well as a method for its operation which avoid the above-mentioned disadvantages of the state of the art and permit a low emission operation of such a system especially during a tanking operation with means as simple and cost-effective as possible.

The method of the invention is for operating a tank system including a tank system of a motor vehicle. The tank system includes: a tank for receiving a fluid medium forming a volatile substance; an adsorption filter connected to the tank for receiving the volatile substance which emanates from the tank; a shutoff valve operatively connected to the adsorption filter and being electrically drivable between an open position and a closed position whereat the tank system is closed off pressure tight with respect to the ambient; a tank fill-level sensor for detecting the fill level of the fluid medium in the tank and for transmitting a signal indicative of the fill level of the fluid medium; and, a fill pipe connected to the tank for filling the tank with the fluid medium. The method includes the steps of: detecting the fill level when tanking the tank; and, driving the shutoff valve into the closed position when the fill level has reached a maximum fill level.

The invention is based on the idea to replace the mechanical valves utilized up to now by the least number of electrical valves possible. Preferably, the invention provides a single electrically drivable check valve which satisfies all of the above-mentioned functions. In the case of a check valve or switch-over valve already present, such as in the initially-mentioned ORVR tank systems, this is retrofitted as an electrical tanking valve in the manner provided by the invention.

Accordingly, the invention advantageously makes unnecessary the mechanical or electrical tank valves required up to now. A check valve or switch-over valve, which is already present for tank leakage diagnosis, is used to satisfy all the functions in accordance with the invention which are necessary for tanking and operational venting. This savings leads to a cost savings as well as to a weight reduction of the motor vehicle concerned. It is noted that the optionally provided tank cap switch also affords advantages for the tank leakage diagnosis because it can, for example, prevent a diagnosis operation from starting so long as the tank cap is open.

In order to prevent still more effectively a splashing at the end of the tanking, it can be further provided that the venting cross section is reduced in a stepwise manner when closing the check valve whereby the overpressure in the tank only increases slowly. In this way, it is prevented that the fuel splashes out of the fill pipe at the end of tanking.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
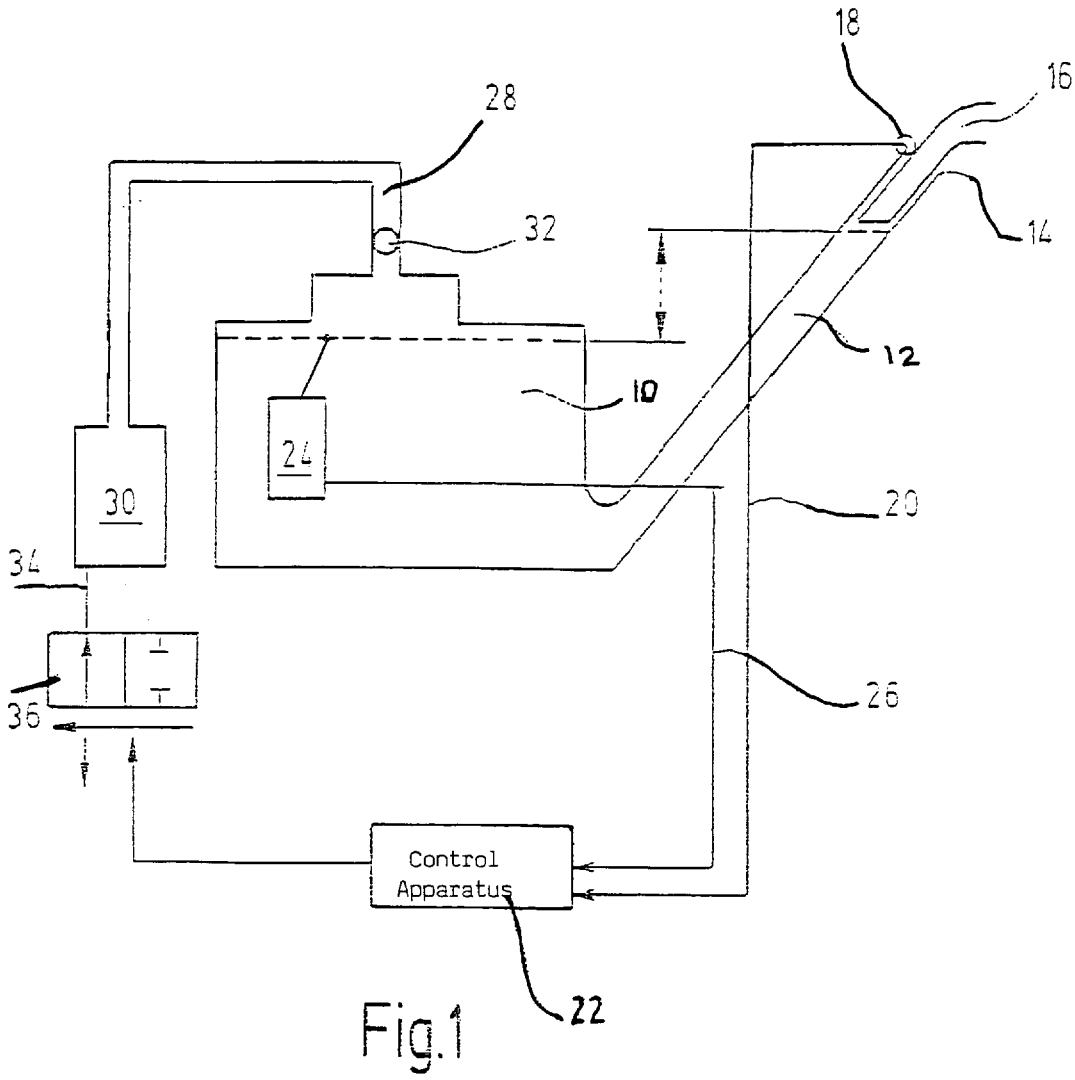
FIG. 1 is a schematic of a tank system according to the invention.

The tank system shown in FIG. 1 includes a fuel supply tank 10 from which a fill pipe 12 extends and by means of which fuel can be filled into the tank 10. A fill nozzle 16 is shown inserted into the region of a fill stub 14 configured on the upper end of the fill pipe. The opening state of the tank cap (not shown) is signalized to a control apparatus 22 via a tank cap switch 18 and via a signal line 20.

In the tank 10, a tank fill level transducer 24 or, alternatively, a fill level end switch is mounted which likewise outputs a measurement signal to the control apparatus 22 via a signal line 26. In addition, a venting line 28 is brought out in the upper region of the tank 10 and opens into an active charcoal filter (ACF) 30. When tanking the tank 10, the fuel vapors which may form are conducted into the ACF 30 and are there trapped. As described in U.S. Pat. No. 5,873,350 incorporated herein by reference, the ACF 30 is from time to time regenerated in that the fuel vapors adsorbed to that time are purged by means of a tank-venting valve (not shown) during operation of the vehicle. This takes place in that the fuel vapor is guided into an intake manifold system of an internal combustion engine (not shown).

A roll-over valve (ROV) 32 is mounted just above the tank 10 in the venting line 28 and is preferably configured mechanically for reasons of safety. This roll-over valve functions to close the venting line 28 in the case of a roll over of the vehicle in order to thereby prevent the unhindered exit of fuel into the ACF 30. On the end facing away from the venting line 28, the ACF 30 has a fresh-air input 34 on which a check valve 36 is mounted in accordance with the feature of the invention. It is noted that the check valve 36 can be replaced by a switch-over valve in the case of a reference leakage diagnostic arrangement mentioned initially herein and as may be required. However, the switch-over valve is likewise to be controlled as described hereinafter.

By means of the check valve 36, the tank system on the one hand can be separated pressure tight from the ambient. It is noted that the check valve 36 can also be mounted at another location, for example, in the venting line 28. The check valve 36 is driven by the control apparatus 22 as described in detail hereinafter. The tank-venting system or the tank system is closed off pressure tight to the ambient by means of the check valve 36 or the switch-over valve for making a tank tightness check from time to time as described in U.S. Pat. No. 5,890,474 incorporated herein by reference.

Figure 2:
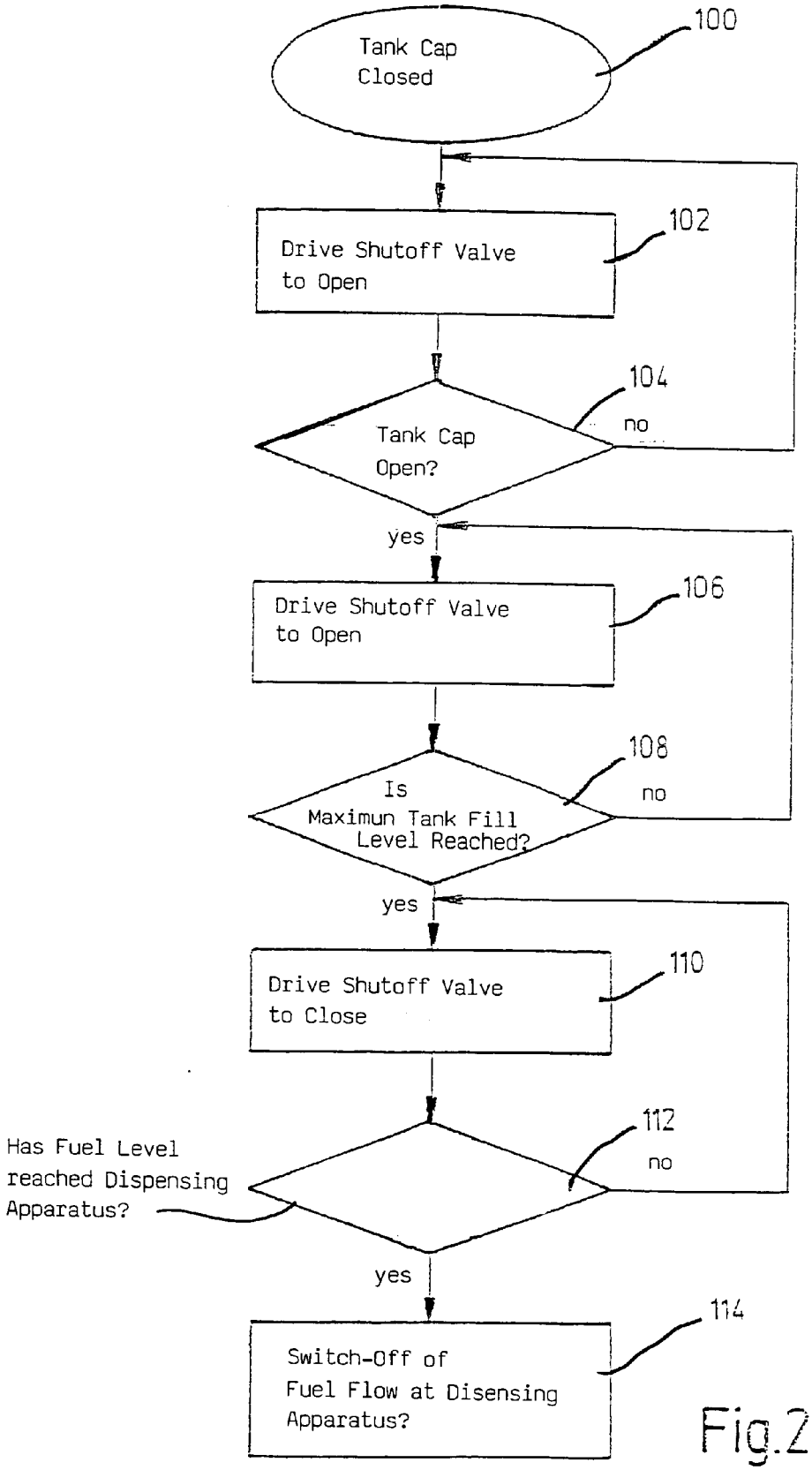
FIG. 2 is a flowchart showing the method of the invention for operating the tank system shown in FIG. 1; and, FIG. 3 is a drive signal of a check valve plotted as a function of time for preventing the splashing of fuel at the end of the tanking operation.

The flowchart shown in FIG. 2 describes a typical operating sequence of the check valve 36 which can be implemented in the control apparatus 22 shown in FIG. 1, for example, by an EPROM or EEPROM. The control apparatus 22 can, for example, be a separate tank control apparatus or is preferably an already available engine control apparatus for managing the engine.

For a tank cap 100 assumed to be closed, the check valve 36 is first driven so as to open (block 102) in order to thereby make possible a venting during operation via the ACF 30. The beginning of the tanking operation is sensed from the opened tank cap by means of the tank-cap switch 18 (block 104). At the start of this tanking operation, the check valve 36 is first driven to be opened wider (block 106) whereby fuel vapor, which escapes because of the filled tank quantity, can escape via the ACF 30; that is, the fuel vapors are reversibly bound in the ACF 30 and the clean air, which exits from the fresh-air input 34 of the ACF 30, can escape into the ambient. In this way, it is avoided that an overpressure is built up already when the tank 10 is being filled. It is noted that an escape of fuel vapor from the fill pipe 12 is prevented by means of a rubber bellows provided in the usual manner on the pistol-shaped fill nozzle 16.

The end of tanking is brought about by the detection of a maximum tank fill level 108 when the tank cap is open. The check valve 36 is driven (block 110) when the two states "open tank cap" and "maximum tank fill level reached or exceeded" are detected by the control apparatus 22. In this way, it is ensured that no further fuel vapors can escape into the ACF 30. As a consequence, the pressure in the tank 10 increases and causes an increase of the fuel level up into the fill pipe 12. As soon as the fuel has reached the fill nozzle 16 (block 112), the fill nozzle switches off the flow of fuel (block 114).

Figure 3:
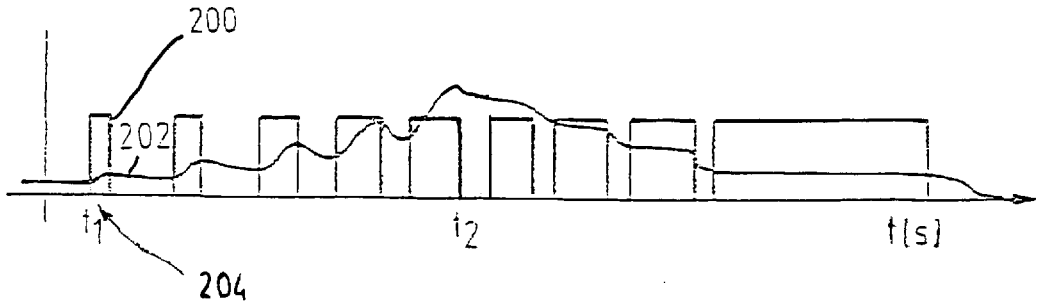

In a further embodiment, the closing of the check valve 36 is not rapid but is stepwise over a time interval (see FIG. 3). The check valve 36 is controlled by a clock signal which causes a stepwise and therefore slow reduction of the opening cross section of the check valve 36. In this way, it is avoided that fuel can still splash over at the fill stub 14 when the tanking operation is being ended.

For a tank leakage diagnosis, which is to be carried out, the check valve 36 is driven to close when the "closed tank cap" is sensed. In the case of an overpressure diagnosis, the pressure in the tank 10 is increased by means of an overpressure pump. The tightness of the tank system is detected in that the overpressure remains stable. In the case of an underpressure method, a tank-venting valve, which is connected to the ACF 30, draws fuel vapors via suction from the tank 10. The tightness is here detected in that the underpressure does not fall off too rapidly.

In a further embodiment, the check valve 36 takes over also the function of the above-mentioned ROV 32. Here, the check valve 36 is driven to close when the state "vehicle turned over" is detected by means of a conventional roll-over sensor system.

The diagram shown in FIG. 3 serves to show the clocked driving of the check valve 36 by means of which a splashing of fuel from the fill pipe 12 when switching off the fill nozzle 16 is avoided. In the diagram, the drive signal 200 as well as the pressure trace p_tank 202 in the tank 10 are plotted as a function of time (t) in a time region after reaching the maximum tank fill level. At t1, the tank fill level reaches the maximum fill height 204. Because of the pulse pattern occurring starting at time t1, the check valve 36 closes only in a stepwise manner. At time t2, the fuel level reaches the fill nozzle 16 which thereupon switches off. The increase in the pressure in the tank 10, which is slowed by the clocked driving of the check valve 36, prevents a splashing when switching off the fill nozzle 16. It is understood that in the case of a leakage diagnostic arrangement having an over-pressure pump or an underpressure pump in lieu of the check valve 36, the pulse pattern shown in FIG. 3 is applied to the there present switch-over valve.

It is understood that the foregoing description is that of the preferred embodiments of the invention and that various changes and modifications may be made thereto without departing from the spirit and scope of the invention as defined in the appended claims.

What is claimed is:

1. A method for operating a tank system including a tank system of a motor vehicle, the tank system including a tank for receiving a fluid medium forming a volatile substance; an adsorption filter having a fresh air inlet and being connected to said tank for receiving the volatile substance which emanates from said tank; a shutoff valve operatively connected to said adsorption filter and being electrically drivable between an open position and a closed position whereat said tank system is closed off pressure tight with respect to the ambient; a tank fill-level sensor for detecting the fill level of said fluid medium in said tank and for transmitting a signal indicative of said fill level of said fluid medium; and, a fill pipe connected to said tank for filling said tank with said fluid medium; the method comprising the steps of:

mounting said shutoff valve at said fresh air inlet of said adsorption filter;

detecting said fill level when tanking said tank; and, driving said shutoff valve into said closed position when said fill level has reached a maximum fill level.

2. The method of claim 1, wherein said shutoff valve is driven into said closed position by applying a clocked driving signal thereto.

3. The method of claim 2, wherein said tank system further comprises a tank cap which can be in an open state or a closed state; and, a tank-cap switch for sensing the open state or closed state of said tank cap; and, wherein the method comprises:

detecting the start of a tanking operation based on said open state of said tank cap sensed by said tank-cap switch; and, detecting the end of said tanking operation when said tank cap is in said open state as a consequence of the level of said fluid medium exceeding a maximum tank fluid level.

4. The method of claim 3, comprising the further steps of:

driving said shutoff valve to open when said tank cap is sensed as being closed by said tank-cap switch;

continuing to drive said shutoff valve to open when said tank cap is sensed as being open by said tank-cap switch;

driving said shutoff valve to close when the maximum tank fill level is exceeded; and, switching off the flow of fuel into said tank when the fluid medium reaches a pistol-like fill nozzle introduced into said fill pipe.

5. The method of claim 4, wherein said tank system includes a tank leakage diagnostic unit; and, wherein the method comprises the further step of driving said shutoff valve to close at the start of a tank leakage diagnosis when said tank cap is sensed as being in said closed state.

6. The method of claim 1, comprising the further step of driving said shutoff valve to close when a roll-over condition of said motor vehicle is sensed.

7. A tank system including a tank system of a motor vehicle, the tank system comprising:

a tank for receiving a fluid medium forming a volatile substance;

an adsorption filter having a fresh air inlet and being connected to said tank for receiving the volatile substance which emanates from the tank;

a shutoff valve mounted at said fresh air inlet of said adsorption filter and being electrically drivable between an open position and a closed position whereat said tank system is closed off pressure tight with respect to the ambient;

a tank fill-level sensor for detecting the fill level of said fluid medium in said tank and for transmitting a signal indicative of said fill level of said fluid medium;

a fill pipe connected to said tank for filling said tank with said fluid medium;

a control apparatus for receiving said signal indicative of said fill level when said tank is filled during a tanking operation; and, said control apparatus being connected to said shutoff valve for electrically driving said shutoff valve into said closed position when said fill level has reached a maximum fill level.

8. The tank system of claim 7, wherein said tank system further comprises a tank cap which can be in an open state or a closed state; a tank-cap switch for sensing the open state of said tank cap; and, said control apparatus functioning to detect said open state of said tank cap from said tank-cap switch and to electrically drive said shutoff valve in dependence upon the detected open state of said tank cap.

9. A tank system including a tank system of a motor vehicle, the tank system comprising:

a tank for receiving a fluid medium forming a volatile substance;

an adsorption filter connected to said tank for receiving the volatile substance which emanates from the tank;

a shutoff valve operatively connected to said adsorption filter and being electrically drivable between an open position and a closed position whereat said tank system is closed off pressure tight with respect to the ambient;

a tank fill-level sensor for detecting the fill level of said fluid medium in said tank and for transmitting a signal indicative of said fill level of said fluid medium;

a fill pipe connected to said tank for filling said tank with said fluid medium;

a control apparatus for receiving said signal indicative of said fill level when said tank is filled during a tanking operation;

said control apparatus being connected to said shutoff valve for electrically driving said shutoff valve into said closed position when said fill level has reached a maximum fill level;

said tank system further comprises a tank cap which can be in an oven state or a closed state; a tank-cap switch for sensing the oven state of said tank cap; and, said control apparatus functioning to detect said oven state of said tank cap from said tank-cap switch and to electrically drive said shutoff valve in dependence upon the detected oven state of said tank cap; and, said adsorption filter having a fresh air inlet and said shutoff valve being mounted at said fresh air inlet.

10. A control apparatus for operating a tank system including a tank system of a motor vehicle, the tank system including a tank for receiving a fluid medium forming a volatile substance; an adsorption filter having a fresh air inlet and being connected to said tank for receiving the volatile substance which emanates from said tank; a shutoff valve mounted at said fresh air inlet of said adsorption filter and being electrically drivable between an open position and a closed position whereat said tank system is closed off pressure tight with respect to the ambient; a tank fill-level sensor for detecting the fill level of said fluid medium in said tank and for transmitting a signal indicative of said fill level of said fluid medium; and, a fill pipe connected to said tank for tilling said tank with said fluid medium; the control apparatus comprising:

means for determining said fill level when tanking said tank from said signal indicative of said fill level; and, means for driving said shutoff valve into said closed position when said fill level has reached a maximum fill level.

11. The control apparatus of claim 10, further comprising means for driving said shutoff valve into said closed position by applying a clocked driving signal thereto.

12. The control apparatus of claim 11, wherein said tank system further comprises a tank cap which can be in an open state or a closed state; and, a tank-cap switch for sensing the open state or closed state of said tank cap; and, wherein the control apparatus further comprises:

means for detecting the start of a tanking operation based on said open state of said tank cap sensed by said tank-cap switch; and, means for detecting the end of said tanking operation when said tank cap is in said open state as a consequence of the level of said fluid medium exceeding a maximum tank fluid level.

13. The control apparatus of claim 12, further comprising:

means for driving said shutoff valve to open when said tank cap is sensed as being closed by said tank-cap switch;

means for continuing to drive said shutoff valve to open when said tank cap is sensed as being open by said tank-cap switch;

means for driving said shutoff valve to close when the maximum tank fill level is exceeded; and, means for switching off the flow of fuel into said tank when the fluid medium reaches a pistol-like fill nozzle introduced into said fill pipe.

14. The control apparatus of claim 13, wherein said tank system includes a tank leakage diagnostic unit; and, wherein said control apparatus further comprises means for driving said shutoff valve to close at the start of a tank leakage diagnosis when said tank cap is sensed as being in said closed state.

15. The control apparatus of claim 10, further comprising means for driving said shutoff valve to close when a roll-over condition of said motor vehicle is sensed.

* * * * *

UNITED STATES PATENT AND TRADEMARK OFFICE

CERTIFICATE OF CORRECTION

PATENT NO. : 6,739,361 B2
DATED : May 25, 2004
INVENTOR(S) : Erwin Krimmer et al.

It is certified that error appears in the above-identified patent and that said Letters Patent is hereby corrected as shown below:

Column 6,
Line 67, delete “oven” and insert -- open -- therefor.

Column 7,
Lines 1, 2 and 5, delete “oven” and insert -- open -- therefor.
Line 21, delete “tilling” and insert -- filling -- therefor.

Signed and Sealed this

Seventeenth Day of August, 2004

JON W. DUDAS
*Acting Director of the United States Patent and Trademark Office*